US011469069B1

(12) United States Patent
Chiu et al.

(10) Patent No.: US 11,469,069 B1
(45) Date of Patent: Oct. 11, 2022

(54) AIRTIGHT SURFACE MOUNT FUSE WITH INSERT CAVITY

(71) Applicant: CONQUER ELECTRONICS CO., LTD., New Taipei (TW)

(72) Inventors: Hung-Chih Chiu, New Taipei (TW); Po-Shuo Chiu, New Taipei (TW)

(73) Assignee: CONQUER ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 17/362,356

(22) Filed: Jun. 29, 2021

(30) Foreign Application Priority Data

Mar. 31, 2021 (TW) ..... 110111991

(51) Int. Cl.
*H01H 85/175* (2006.01)
*H01H 85/055* (2006.01)

(52) U.S. Cl.
CPC ..... *H01H 85/175* (2013.01); *H01H 85/055* (2013.01)

(58) Field of Classification Search
CPC .. H01H 85/0411; H01H 85/06; H01H 85/165; H01H 85/08; H01H 85/055; H01H 85/175; H01H 85/1755; H01H 2085/0412; H01H 2085/0414
See application file for complete search history.

(56) References Cited

U.S. PATENT DOCUMENTS 1,540,119 A * 6/1925 Glowacki ..... H01H 85/10 337/295
4,918,420 A * 4/1990 Sexton ..... H01H 69/02 337/205
5,572,181 A * 11/1996 Kiryu ..... H01H 85/0411 337/273
5,644,281 A * 7/1997 Kuriyama ..... H01G 9/0003 337/295
5,648,750 A * 7/1997 Yuza ..... H01H 85/0411 337/252
2003/0024105 A1* 2/2003 Chiu ..... H01H 85/0411 29/623
2007/0075822 A1* 4/2007 Pachla ..... H01H 85/0411 337/297
2008/0191832 A1* 8/2008 Tsai ..... H01H 85/046 337/297
2012/0133478 A1* 5/2012 Chiu ..... H01H 85/165 337/228

(Continued)

*Primary Examiner* — Jacob R Crum
(74) *Attorney, Agent, or Firm* — Muncy Geissler Olds & Lowe P.C.

(57) ABSTRACT

An airtight surface mount fuse with a cavity has a housing, a conductive fuse, a cover and an encapsulant. The housing has an opening and an airtight inner space. The fusible element has a part disposed inside of the airtight inner space and another part exposed from the opening. The cover is configured to fit into the opening. The encapsulant encapsulates the housing, the cover and a segment of the exposing part of the fusible element. The other segment of the fusible element is exposed from the encapsulant. The inner space of the housing is encapsulated by the encapsulant and becomes airtight. The fusible element is disposed inside of the airtight inner space to prevent the hazard occurring from arc spark interacting with flammable gases when a fusible body of the fusible element is fused. It also ensures the fusible body is affected by the external environment.

20 Claims, 7 Drawing Sheets

(56) References Cited

U.S. PATENT DOCUMENTS

| | | | | |
|---|---|---|---|---|
| 2016/0111240 | A1* | 4/2016 | Beckert | H01H 69/02 337/187 |
| 2016/0217960 | A1* | 7/2016 | Abad | H01H 85/175 |
| 2017/0236675 | A1* | 8/2017 | Aberin | H01H 69/02 337/159 |
| 2018/0294126 | A1* | 10/2018 | de Leon | H01H 85/18 |
| 2019/0318894 | A1* | 10/2019 | Chiu | H01H 85/1755 |
| 2020/0196442 | A1* | 6/2020 | Woodley | H01H 85/0241 |
| 2020/0227225 | A1* | 7/2020 | Yokomizo | H01H 85/08 |

* cited by examiner

AIRTIGHT SURFACE MOUNT FUSE WITH INSERT CAVITY

CROSS-REFERENCE TO RELATED APPLICATIONS

This application is based upon and claims priority under 35 U.S.C. 119 from Taiwan Patent Application No. 110111991 filed on Mar. 31, 2021, which is hereby specifically incorporated herein by this reference thereto.

BACKGROUND OF THE INVENTION

1. Field of the Invention

The present disclosure relates to a surface mount fuse, particularly, to a surface mount fuse mounted with a surface mounting technology.

2. Description of the Prior Arts

The conventional fuse includes a fusible element. When an abnormal condition (e.g., overcurrent) occurs to a circuit, having the fuse connected in series for protection, the fusible element is fused due to overheating, so that the protected circuit is opened to achieve the function of protecting the circuit.

Nowadays, the fuses are used in a variety of different circumstances, from factories to outer space. In one circumstance that a conventional fuse is used in a factory environment with flammable gases, the fire hazard may occur since the flammable gases is ignited by a spark causing by an arc when the fusible element is fused. The arc is produced because the electric field intensity at both ends of the break point is extremely strong that makes the air, which should be the insulating medium, easily being broken down. In another circumstance that a conventional fuse is used in a special environment (e.g., outer space), which has no experimental data on how it will affect the fusible element, the conventional fuse could malfunction due to the unknown environmental condition. Therefore, it is necessary to further improve it.

SUMMARY OF THE INVENTION

In view of the shortcomings of the above fuse, the main objective of the present disclosure is to provide an improved airtight surface mount fuse with a cavity, which can be used in different environments.

The main technical features used to achieve the objective of the invention is that the airtight surface mount fuse with a cavity includes:

a housing, comprising an opening and an airtight inner space;

a fusible element, comprising a fusible body, two intermediary portions and two conductive portions, wherein each of the intermediary portions is connected between a corresponding end of the fusible body and the corresponding conductive portion, the fusible body and the two intermediary portions are disposed inside of the inner space of the housing, and each of the conductive portions extends out of the housing from the opening;

a cover, disposed on the opening; and an encapsulant, encapsulating the housing, the cover and a part of the conductive portions of the fusible element The part of the conductive portion being encapsulated is located at the joint between the housing and the cover.

According to the above explanation, since the airtight surface mount fuse with a cavity includes an encapsulant configured to encapsulate the housing, the cover, and a part of the conductive portion of the fusible element located at the joint between the housing and the cover, the gaps between the housing, the cover and the conductive portion are completely sealed. Thus, the inner space of the housing becomes an airtight inner space. The hazard occurring from arc spark interacting with flammable gases is prevented by disposing the fusible body of the fusible element in the airtight inner space. It also ensures the fusible body is not affected by the external environment since the fusible body is disposed inside of the airtight inner space, so that the airtight surface mount fuse with a cavity can be used in different environments.

Other objectives, advantages and novel features of the invention will become more apparent from the following detailed description when taken in conjunction with the accompanying drawings.

DETAILED DESCRIPTION OF THE EMBODIMENTS

Figure 1:
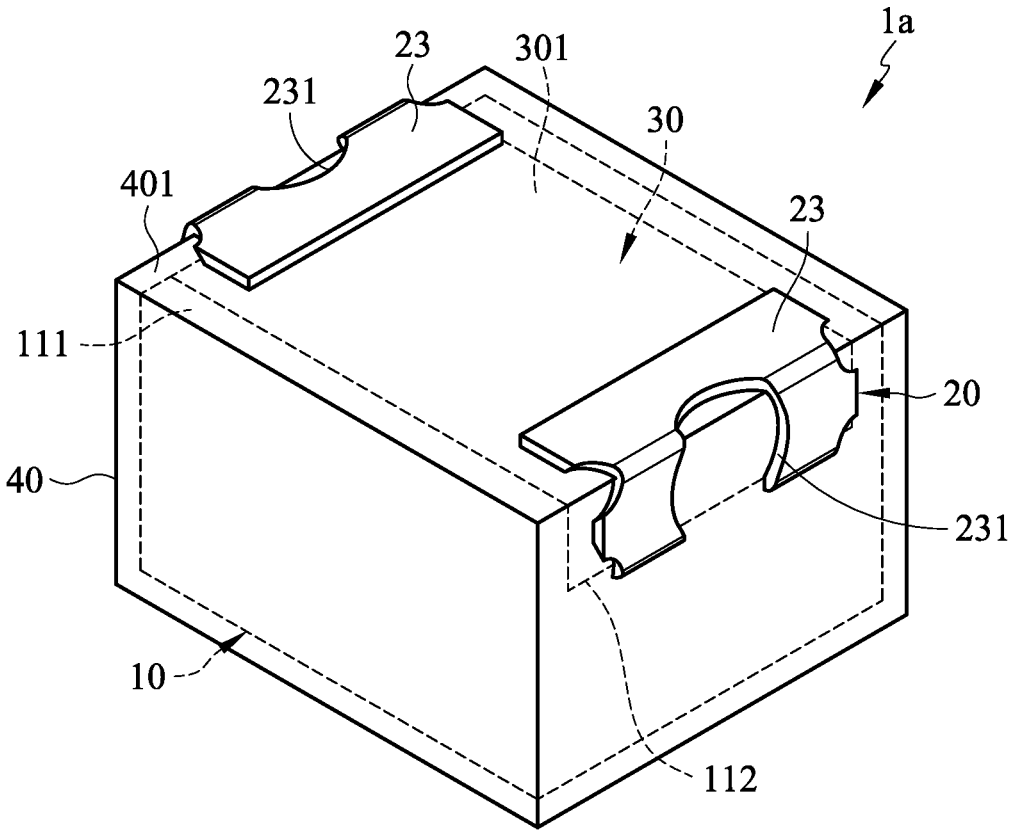
FIG. 1 is a perspective view of a first embodiment of an airtight surface mount fuse with a cavity in accordance with the present invention.

Referring to FIG. 1, a first embodiment of an airtight surface mount fuse 1*a* with a cavity in accordance with the present invention includes a housing 10, a fusible element 20, a cover 30 and an encapsulant 40.

Figure 2:
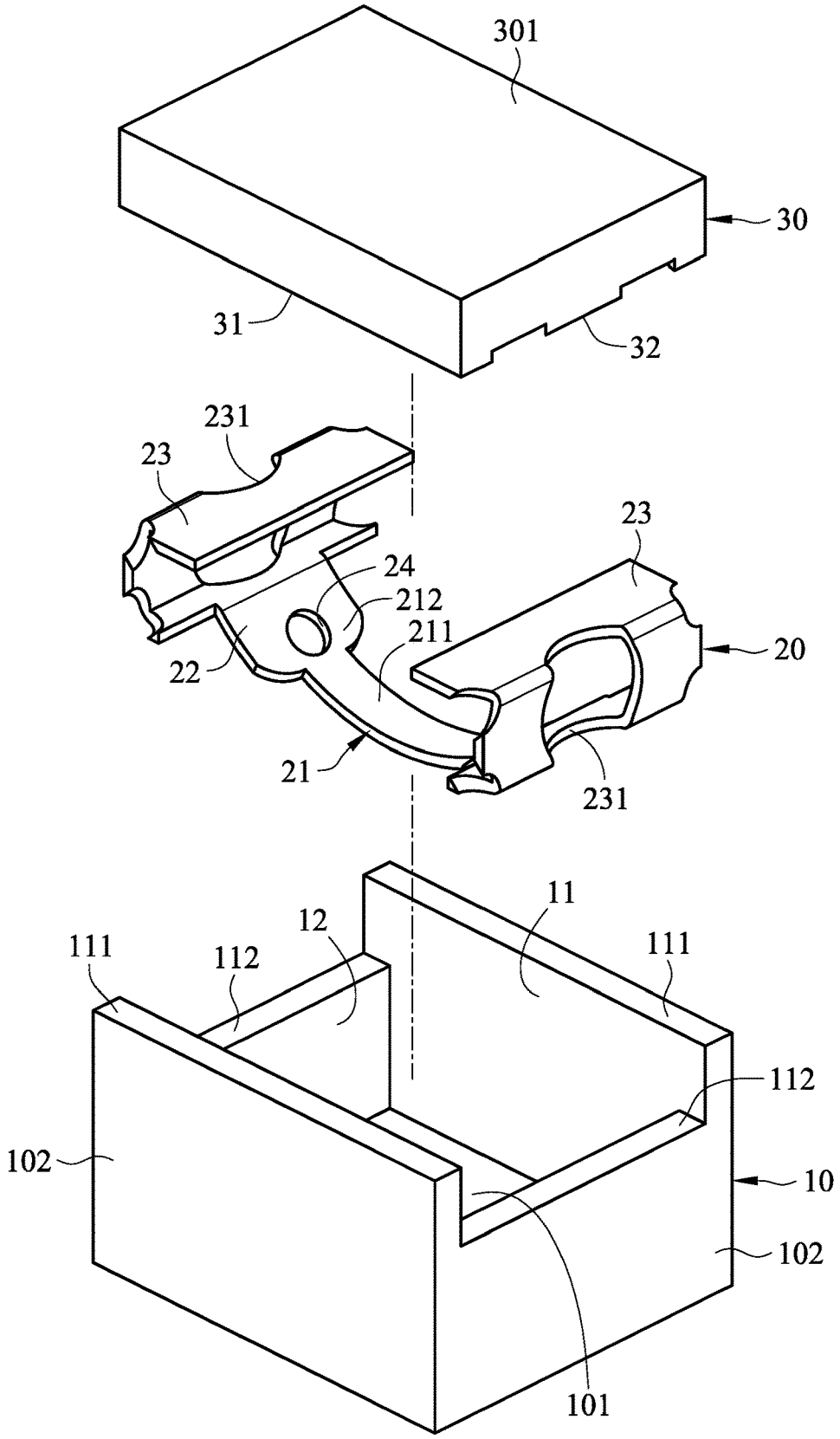
FIG. 2 is an exploded perspective view of the airtight surface mount fuse with a cavity in FIG. 1, showing without the encapsulant.

As shown in FIG. 2, the housing 10 includes an opening 11 and an inner space 12. In the present embodiment, the housing 10 is a cuboid and includes a rectangular main wall 101 and four sidewalls 102 respectively extending vertically from the four sides of the main wall 101. The sidewalls 102 are connected to each other to form the inner space 12 and the opening 11. The opening 11 of the housing 10 is rectangular and includes two opposing first sides 111 and two opposing second sides 112. In an exemplary embodiment as shown in FIG. 1, the height of the two opposing first sides 111 is higher than the height of the two opposing second sides 112. In an exemplary embodiment, the first sides 111 are the longer sides and the second sides 112 are the shorter sides. The material of the housing 10 is a ceramic material, but the present invention is not limited thereto.

Figure 4:
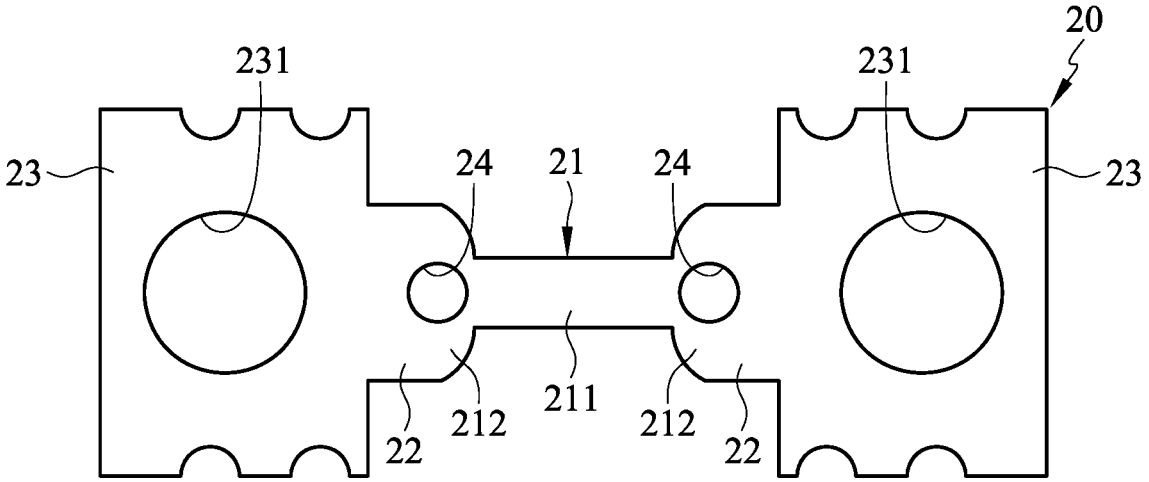
FIG. 4 is a top view of a fusible element of the airtight surface mount fuse with a cavity in FIG. 1, showing before bending.
Figure 5A:
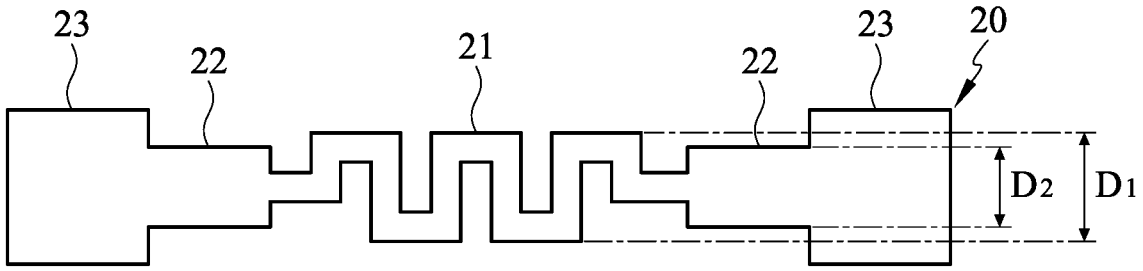
FIG. 5A is a top view of another embodiment of a fusible element, showing before bending.
Figure 5B:
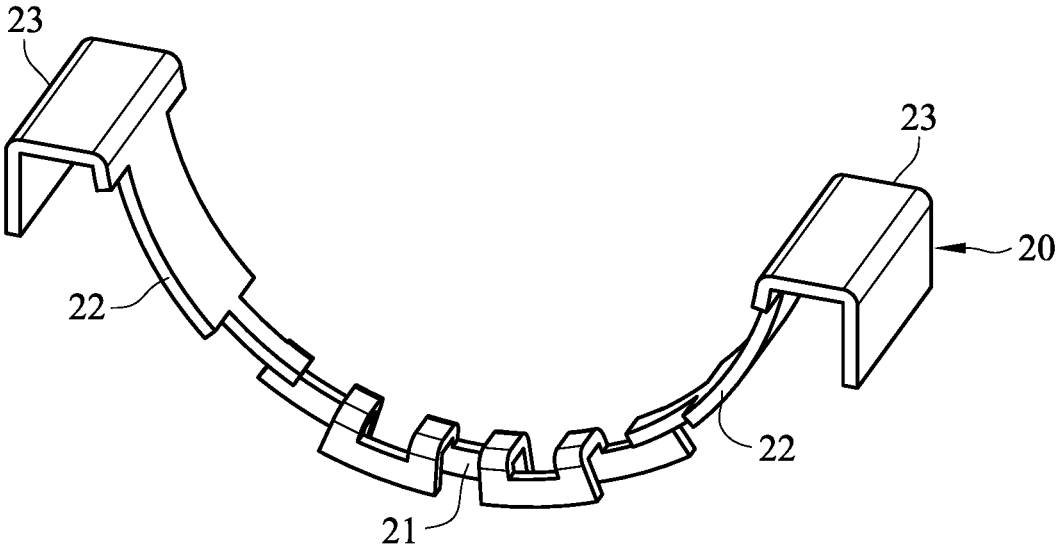
FIG. 5B is a perspective view of the fusible element as shown in FIG. 5A after bending.

As shown in FIG. 2 and FIG. 4, the fusible element 20 is mounted on the opening 11 of the housing and includes a fusible body 21, two intermediary portions 22 and two conductive portions 23. In the present embodiment, each of the intermediary portions 22 is connected between a corresponding end of the fusible body 21 and the corresponding conductive portion 23 in one-piece The fusible body 21 and the two intermediary portions 22 are adapted to accommodate into the inner space 12 of the housing 10 and curved downward toward the main wall 101 of the housing 10. The two conductive portions 23 of the fusible element 20 are disposed, respectively, on the two opposing second sides 112 of the opening 11. In an exemplary embodiment, as shown in FIG. 4, the fusible body 21 further includes a first segment 211 and two second segments 212 respectively facing and extending toward each of the intermediary portions 22. The first segment 211 is linear. The width of the first segment 211 is less than the width of each of the second segments 212. The transverse width of the first segment 211 is less than the transverse width of each of the second segments 212. A gap 24 is formed in each of the second segments 212, so that the distance between both ends of the fusible body 21 can be lengthen by the gaps 24 after the fusible body 21 being fused, and thus reduce the possibility to generate the electric arc. Each of the conductive portions 23 forms a hole. In an exemplary embodiment, the material of the fusible element 20 can be metals (e.g., silver, copper, nickel, tin, aluminum, zinc, etc.) or alloys made of the above metals. On the other hand, in another exemplary embodiment of the fusible element 20 as shown in FIG. 5A, the fusible body 21 is bent in a non-linear plane path so that the fusible body 21 extends the total length without increasing the distance between the intermediary portions 22 to protect circuits with lower rated current (e.g., 10 A to 0.5 A). In addition, the width D1 of the fusible body 21 is greater than the width D2 of each intermediary portion 22. Further referring to FIG. 5B, before the fusible element 20 is placed into the inner space 12 of the housing 10 as shown in FIG. 2, the fusible body 21 and the two intermediary portions 22 of the fusible element 20 are bent downward and toward the main wall 101 to form an arc shape, that is, the fusible body 21 and the two intermediary portions 22 are bent away from the opening 11, and the both sides of the fusible body 21 are also bent away from the opening 11 to reduce the width of the fusible body 21, so that the fusible element 20 can be more easily placed into the inner space 12 of the housing 10.

Figure 3:
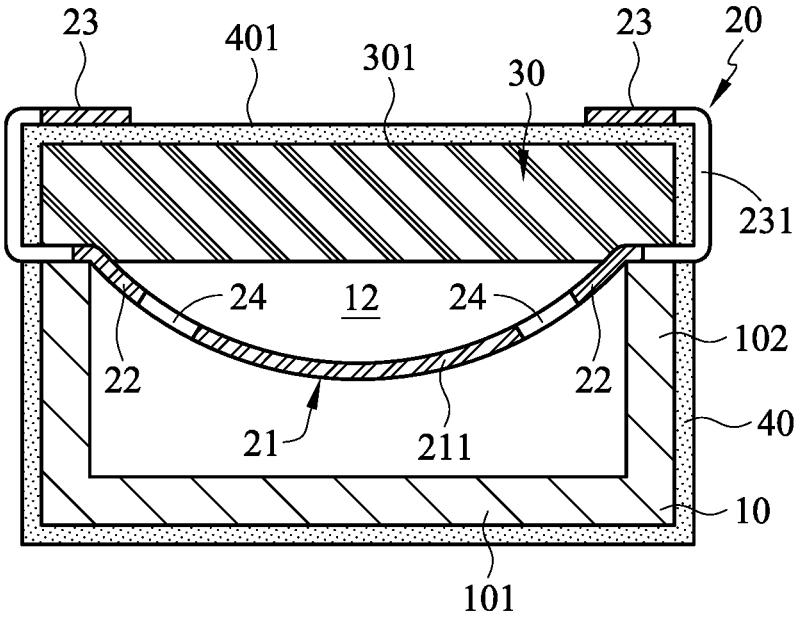
FIG. 3 is a cross-sectional side view of the airtight surface mount fuse with a cavity in FIG. 1.

As shown in FIG. 2 and FIG. 3, the cover 30 is adapted to fit into the opening 11 of the housing to seal the fusible body 21 of the fusible element 20 into the inner space 12 of the housing 10. In the present embodiment, the cover 30 is a cuboid, which means the cover 30 includes two opposing third sides 31 and two opposing fourth sides 32. The two fourth sides 32 are disposed on two second sides 112 of the opening 11. Further referring to FIG. 1, the external surface 301 of the cover 30 is flush with the two first sides 111 of the opening 11, so that the two conductive portions 23 of the fusible element 20 are respectively disposed on the two opposing second sides 112 of the opening 11 and exposed out of the opening 11. In an exemplary embodiment, the cover 30 is made of a ceramic material or a plastic material.

As shown in FIG. 1 and FIG. 3, the housing 10, the cover 30, and a part of the conductive portion 23 located at the joint between the housing 10 and the cover 30 are encapsulated by the encapsulant 40, so that the gaps between the housing 10, the cover 30 and the conductive portion 23 can be sealed by the encapsulant 40. Therefore, the inner space 12 of the housing 10 becomes an airtight inner space 12, and the conductive portions 23 of the fusible element 20 have a part exposing out of the encapsulant 40. Referring to FIG. 1 again, the exposing part of the conductive portions 23 is bent toward to the cover 30 and attached to a surface 401, which corresponds to the surface 301 of the cover 30, of the encapsulant 40, so as to form the airtight surface mount fuse 1*a* with a cavity. Each conductive portion 23 can be easily bent and attached to the encapsulant 40 due to the hole 231 formed on each conductive portion 23. In an exemplary embodiment, the encapsulant 40 is formed by embedded insert molding. The encapsulant 40 can be made of, but not limited to, silicon, epoxy, nylon, or engineering plastics.

In an exemplary embodiment, the exposing part of the conductive portions 23 of the fusible element 20 has not yet been bent when the cover is assembled to the fusible element 20. The exposing part of the conductive portions 23 is bent and attached to the surface 401 of the encapsulant 40 after the housing 10 and the cover 30 are encapsulated by the encapsulant 40.

Figure 6:
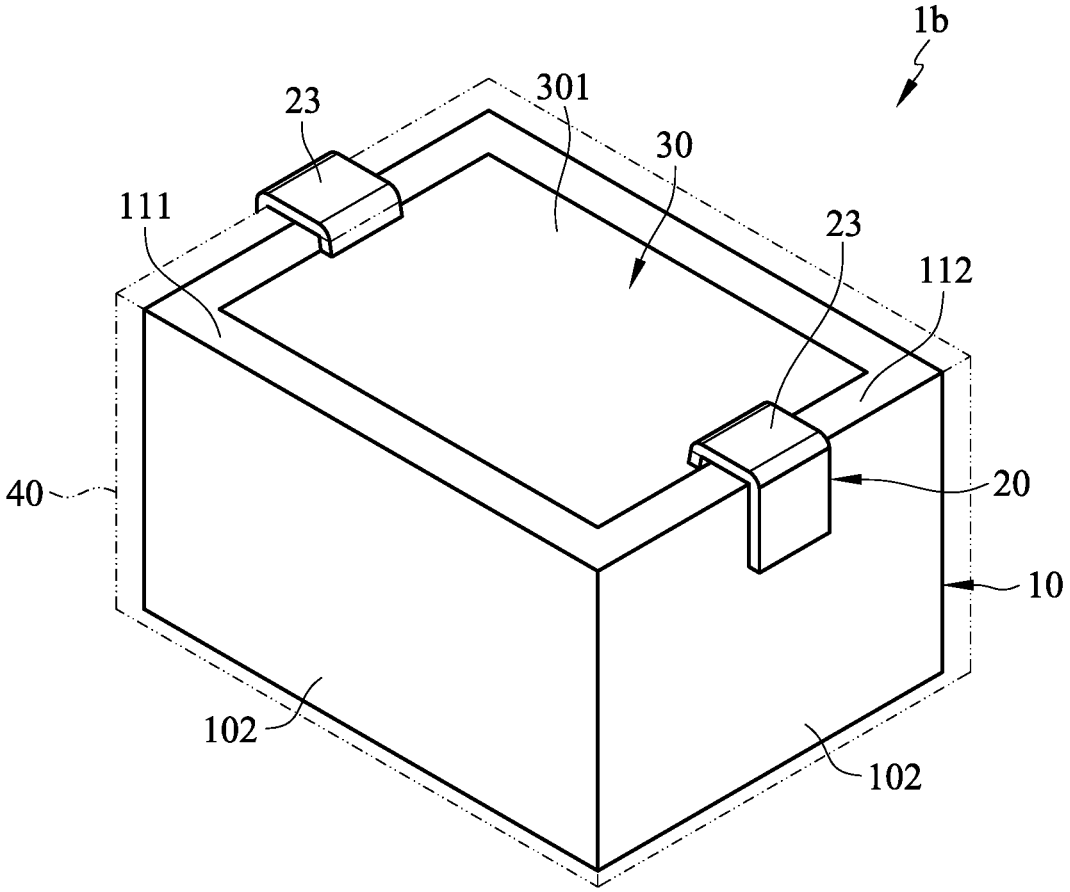
FIG. 6 is a perspective view of a first embodiment of an airtight surface mount fuse with a cavity in accordance with the present invention.

Referring to FIG. 6, illustrating the surface mount fuse 1*b* according to a second embodiment of the present disclosure, the surface mount fuse 1*b* is similar to the surface mount fuse 1*a* shown in FIG. 1, except that the two opposing first sides 111 and the two opposing second sides 112 of the opening 11 of the housing 10 are of the same height. The cover 30 is configured to fit into the opening 11, which means the external surface 301 of the cover 30 is flush with the two first sides 111 and the two second sides 112 of the opening. The two conductive portions 23 of the fusible element 20 are respectively toward to the two second sides of the opening 11 and exposed from the opening 11. The housing 10, the cover 30, and a part of the conductive portion 23 located at the joint between the housing 10 and the cover 30 are further encapsulated by the encapsulant 40, and then parts of the two conductive portions 23 exposing out of the encapsulant 40 are respectively bent and attached to the encapsulant 40 encapsulating the corresponding second side 112 and the external surface of the housing 10.

Figure 7:
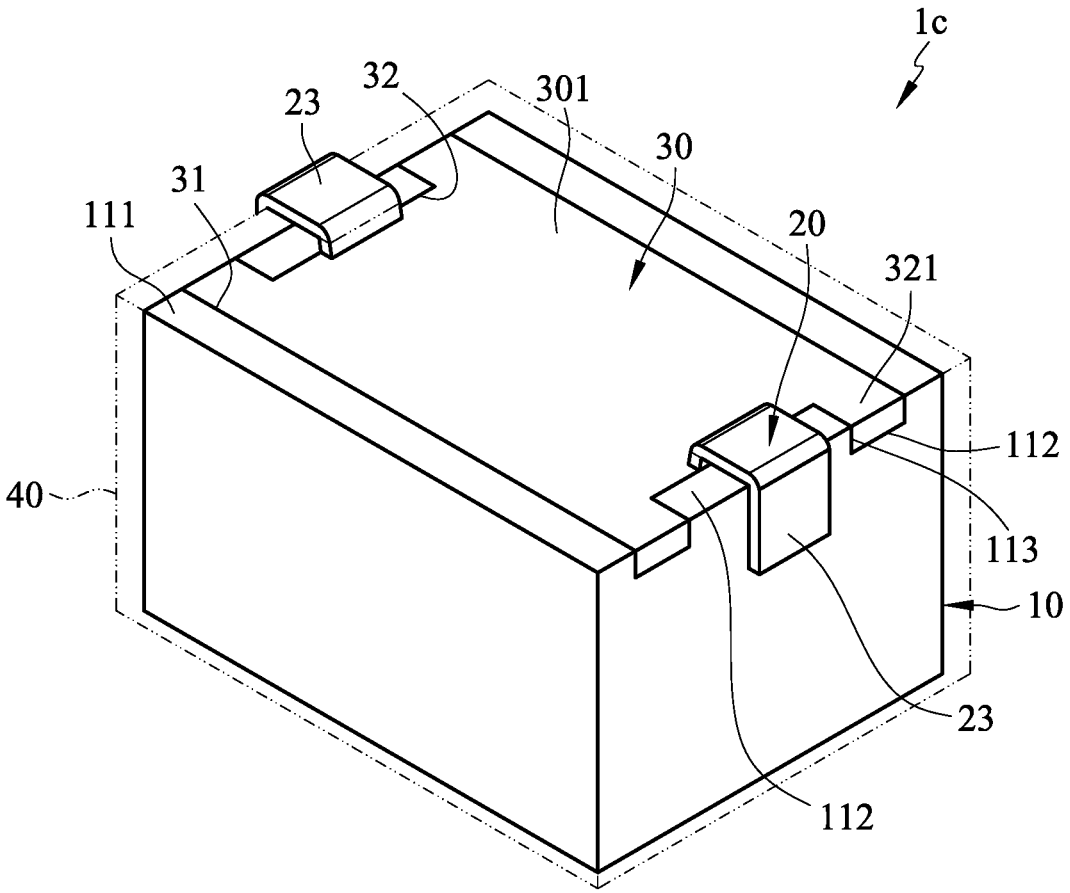
FIG. 7 is a perspective view of a first embodiment of an airtight surface mount fuse with a cavity in accordance with the present invention.

Referring to FIG. 7, illustrating the surface mount fuse 1*c* according to a third embodiment of the present disclosure. The surface mount fuse 1*c* of the present embodiment is similar to the second embodiment shown in FIG. 6. In the present embodiment, the housing 10 has two buttonholes 113 respectively formed on the two opposing second sides 112 of the opening 11. Since the cover 30 is configured to fit into the opening 11, the two opposing fourth sides 32 of the cover 30 are respectively corresponding to each buttonhole 113 formed on the second sides 112 of the opening 11. The cover 30 has two buttons 32 horizontally extended from its two opposing fourth sides 32 and configured to assemble the buttonholes 113 of the opening 11 by the interference fit and make the external surface 301 of the cover 30 flushing with the two first sides 111 and the two second sides 112 of the opening 11. In an exemplary embodiment, the cover 30 is made of a plastic material.

In conclusion, since the inner space of the housing becomes an airtight inner space by encapsulating the housing and the cover with the encapsulant and the fusible body of the fusible element is disposed inside of the airtight inner space, the hazard occurring from arc spark interacting with flammable gases when the fusible body is fused is prevented. It also ensures the fusible body is not affected by the external environment since the fusible body is disposed inside of the airtight inner space, so that the airtight surface mount fuse with a cavity can be used in different environments.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An airtight surface mount fuse with a cavity, comprising:

a housing having an opening and an airtight inner space, wherein the opening comprises two first sides and two second sides;

a fusible element having a fusible body, two intermediary portions and two conductive portions, wherein each of the intermediary portions is connected between a corresponding end of the fusible body and the corresponding conductive portion, the fusible body and the two intermediary portions are disposed inside of the inner space of the housing, and each of the conductive portions extends out of the housing from the opening;

a cover disposed on the opening of the housing and comprising an external surface, two third sides and two fourth sides, wherein the external surface of the cover is flush with the two first sides of the opening; and an encapsulant encapsulating the housing, the cover and a part of the conduction portions located at the joint between the housing and the cover, wherein the two conductive portions of the fusible element have a part exposing out of the encapsulant, which is bent and attached to the encapsulant which encapsulates a corresponding part of the external surface of the cover.

2. The airtight surface mount fuse with a cavity according to claim 1, wherein the two intermediary portions and the fusible body are bent away from the opening to form an arc shape.

3. The airtight surface mount fuse with a cavity according to claim 2, wherein the height of the two first sides of the opening is higher than the height of the two second sides;

the two fourth sides of the cover are disposed on the two second sides of the opening; and the two conductive portions of the fusible element are respectively disposed on the two second sides of the opening.

4. The airtight surface mount fuse with a cavity according to claim 2, wherein the cover is configured to fit into the opening; and the external surface of the cover is flush with the two second sides of the opening; and the part of each conductive portion of the fusible element, exposing out of the encapsulant, is attached to the encapsulant which encapsulates the corresponding second side of the opening and encapsulates an external surface of the housing.

5. The airtight surface mount fuse with a cavity according to claim 2, wherein at least one buttonhole is formed on each of the two second sides of the opening;

the cover is configured to fit into the opening;

a button is disposed and horizontally extended from each of the two fourth sides, respectively corresponding to the buttonholes on the second sides, and configured to assemble the corresponding buttonhole;

the external surface of the cover is flush with the two second sides of the opening; and the part of each of the two conductive portions of the fusible element, exposing out of the encapsulant, is attached to the encapsulant which encapsulates the corresponding second side of the opening and encapsulates an external surface of the housing.

6. The airtight surface mount fuse with a cavity according to claim 1, wherein the fusible body of the fusible element further comprises:

a first segment; and two second segments, extended from two end of the first segment, and respectively connected to the corresponding intermediary portion.

7. The airtight surface mount fuse with a cavity according to claim 2, wherein the fusible body of the fusible element further comprises:

a first segment; and two second segments, extended from two end of the first segment, and respectively connected to the corresponding intermediary portion.

8. The airtight surface mount fuse with a cavity according to claim 3, wherein the fusible body of the fusible element further comprises:

a first segment; and two second segments, extended from two end of the first segment, and respectively connected to the corresponding intermediary portion.

9. The airtight surface mount fuse with a cavity according to claim 4, wherein the fusible body of the fusible element further comprises:

a first segment; and two second segments, extended from two end of the first segment, and respectively connected to the corresponding intermediary portion.

10. The airtight surface mount fuse with a cavity according to claim 5, wherein the fusible body of the fusible element further comprises:

a first segment; and two second segments, extended from two end of the first segment, and respectively connected to the corresponding intermediary portion.

11. The airtight surface mount fuse with a cavity according to claim 6, wherein:

the first segment of the fusible body is linear; and a transverse width of the two intermediary portions is greater than a transverse width of the first segment of the fusible body.

12. The airtight surface mount fuse with a cavity according to claim 10, wherein:

the first segment of the fusible body is linear; and a transverse width of the two intermediary portions is greater than a transverse width of the first segment of the fusible body.

13. The airtight surface mount fuse with a cavity according to claim 11, wherein a hole is formed on each conductive portion of the fusible element.

14. The airtight surface mount fuse with a cavity according to claim 12, wherein a hole is formed on each conductive portion of the fusible element.

15. The airtight surface mount fuse with a cavity according to claim 1, wherein the material of the fusible element comprises silver, copper, nickel, tin, aluminum, zinc, or their alloys.

16. The airtight surface mount fuse with a cavity according to claim 1, wherein the fusible body of the fusible element is bent in a non-linear plane path.

17. The airtight surface mount fuse with a cavity according to claim 2, wherein the fusible body of the fusible element is bent in a non-linear plane path.

18. The airtight surface mount fuse with a cavity according to claim 3, wherein the fusible body of the fusible element is bent in a non-linear plane path.

19. The airtight surface mount fuse with a cavity according to claim 4, wherein the fusible body of the fusible element is bent in a non-linear plane path.

20. The airtight surface mount fuse with a cavity according to claim 5, wherein the fusible body of the fusible element is bent in a non-linear plane path.

* * * * *